US006409120B1

(12) United States Patent
Tramontina et al.

(10) Patent No.: US 6,409,120 B1
(45) Date of Patent: Jun. 25, 2002

(54) DISPENSER APPARATUS AND METHOD

(75) Inventors: Paul F. Tramontina, Alpharetta; Stephen L. Phelps, Lilburn, both of GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/537,275

(22) Filed: Mar. 29, 2000

(51) Int. Cl.[7] ..... B65H 16/02

(52) U.S. Cl. ..... 242/594.5; 242/596.3; 242/596.4; 242/598.1; 242/598.4

(58) Field of Search ..... 242/594.5, 594.6, 242/594, 596.4, 596.5, 596.6, 596.1, 596.2, 596.3, 598.1, 598.4

(56) References Cited

U.S. PATENT DOCUMENTS

| | | | | |
|---|---|---|---|---|
| 1,057,614 A | | 4/1913 | Bedell et al. | |
| 2,555,885 A | * | 6/1951 | Hope | 242/596.4 |
| 2,565,994 A | * | 8/1951 | Sevenich | 242/596.4 |
| 2,722,387 A | * | 11/1955 | Tuttle | 242/594.5 |
| 2,819,852 A | | 1/1958 | Sarro | |
| 2,879,012 A | | 3/1959 | Sarro | |

(List continued on next page.)

FOREIGN PATENT DOCUMENTS

| | | | | |
|---|---|---|---|---|
| EP | 0276662 A1 | | 8/1988 | |
| EP | 283421 | * | 9/1988 | 242/594.5 |
| EP | 0 406 154 A1 | | 4/1990 | |
| EP | 0729724 A1 | | 9/1996 | |
| FR | 1407112 | | 12/1965 | |
| IT | 248693 | * | 6/1926 | 242/594.5 |
| WO | WO99/12461 | | 3/1999 | |

OTHER PUBLICATIONS

KCX–235–PCT, PCT/US 01/09686, International Search Report filed Mar. 26, 2001, entitled Dispenser Apparatus and Method.

U.S. Pat. 09/461,952, Tramontina, "Dispenser Apparatus and Method", filed Dec. 15, 1999 (KCX–234) (KC–14775), specifications and drawings.

Copy of Search Report for International PCT Application KCX–234 (KC#14775).

*Primary Examiner*—Emmanuel M. Marcelo
(74) *Attorney, Agent, or Firm*—Dority & Manning, P.A.

(57) ABSTRACT

The invention comprises a method and apparatus for more efficiently and easily dispensing paper products, such as toilet tissue, from commercial wall mounted dispensers. The invention may comprise spring loaded projections on the interior of the housing that are adapted to receive and suspend within the housing rolls of paper tissue. Doors within the housing are configured to allow insertion of a new roll of paper into the dispenser when located in the open position; further, such doors suspend the tail of the paper roll for easy access to the tissue user when the doors are in the closed position. An accessory feature facilitates the dispensing of a stub roll or partially consumed roll, as well as a new roll, upon reloading of the dispenser. One or more windows are provided to enable maintenance personnel to determine when reloading the dispenser is required.

20 Claims, 8 Drawing Sheets

U.S. PATENT DOCUMENTS 2,908,451 A * 10/1959 Tucker et al. ..... 242/596.3
3,029,035 A 4/1962 Layton
3,095,996 A 7/1963 Babin
3,494,518 A 2/1970 Goss
3,632,017 A 1/1972 Matthews
3,865,295 A 2/1975 Okamura
3,878,998 A 4/1975 Lazzari
4,098,469 A 7/1978 McCarthy
4,135,678 A 1/1979 Williams
4,306,687 A 12/1981 Hadtke
4,383,656 A 5/1983 Campbell
4,398,656 A 8/1983 McCadden
4,444,359 A 4/1984 Butler
4,564,148 A 1/1986 Wentworth
4,614,312 A 9/1986 Del Pino
4,634,067 A 1/1987 White
4,774,799 A 10/1988 Durant
4,796,832 A * 1/1989 Schutz et al. ..... 242/594.5
4,811,878 A 3/1989 Horinchi
4,832,271 A 5/1989 Geleziunas
4,877,154 A 10/1989 Matsui
5,000,393 A 3/1991 Madsen
5,058,792 A 10/1991 Morand
5,149,003 A 9/1992 Tharp
5,170,958 A 12/1992 Brown
5,172,840 A 12/1992 Bloch
5,253,818 A 10/1993 Craddock
D351,520 S 10/1994 Frazier et al.
5,454,500 A 10/1995 Chen
5,509,593 A 4/1996 Bloch
5,601,253 A 2/1997 Formon
5,618,008 A 4/1997 Dearwester et al.
5,620,148 A 4/1997 Mitchell
5,645,244 A 7/1997 Moody
5,697,576 A 12/1997 Bloch et al.
5,829,710 A 11/1998 Halle
5,833,169 A 11/1998 Morand
5,868,335 A 2/1999 LeBrun
5,875,985 A 3/1999 Cohen et al.
5,884,804 A 3/1999 King
5,915,645 A * 6/1999 Granger ..... 242/596.3
5,954,256 A 9/1999 Niada
6,047,920 A * 4/2000 Dearwester et al. ..... 242/594.5
6,056,233 A * 5/2000 Von Scheenk ..... 242/594.5
6,082,664 A * 7/2000 Phelps et al. ..... 242/596.5
6,092,758 A * 7/2000 Gemmell ..... 242/596.4
6,092,759 A * 7/2000 Gemmell et al. ..... 242/596.2
6,105,898 A 8/2000 Byrd et al.
6,138,939 A * 10/2000 Phelps et al. ..... 242/594.4
6,179,243 B1 * 1/2001 Granger ..... 242/598.1
6,189,828 B1 * 2/2001 Reilly ..... 242/296.4

* cited by examiner

DISPENSER APPARATUS AND METHOD

FIELD OF THE INVENTION

This invention relates to dispensing apparatus and methods, and in particular rolled paper dispensing apparatus for delivering absorbent paper products such as toilet tissue, hand towels and the like.

BACKGROUND OF THE INVENTION

Commercial and consumer absorbent paper products typically are distributed and dispensed from rolls. Rolled paper products may be dispensed, stored and maintained using a hollow cylindrical core which forms the support structure about which the paper is wrapped. Most paper toweling and consumer toilet tissue products contain a cardboard core, and the rolled product is often dispensed by mounting the core on a spindle passing through the core of the roll. In some cases, a mounting structure or wire frame operatively engages each end of the core, thereby suspending the rolled product to facilitate dispensing of the paper.

Large or jumbo sized toilet tissue rolls are dispensed in restrooms of commercial buildings and in other locations where high volumes of rolled paper products are needed. Typically, these large size rolls include a core in the center of the roll. Usually, the rolls are mounted in dispensers so that the core of the roll is supported on a hub, or axis of rotation, within the dispenser housing. These large size rolls may be largely invisible to the consumer, as they often are dispenser. Other dispensers employ a hinged housing cover, which must be opened or moved laterally to facilitate reloading the dispenser. Reloading dispensers is a time consuming task for maintenance personnel. In general, it is desirable to provide a process for reloading dispensers in a manner that is efficient and simple. One challenge in commercial dispenser design is to provide a dispenser that may be reloaded easily and quickly, but still offers security to the rolled paper product, thereby protecting the dispenser contents from vandalism and theft.

Coreless rolls of paper product are employed in applications where it is desirable to avoid using a core in the center of the rolled product. Coreless rolled products may be manufactured as provided in U.S. Pat. No. 5,620,148 to form a depression in the side of the roll that facilitates supporting and dispensing the roll. Devices capable of dispensing coreless rolled paper products have been disclosed as provided for example in U.S. Pat. No. 5,697,576. Another patent, U.S. Pat. No. 5,875,985, is directed to a method of treating a coreless roll to create a mounting hole in at least one end of the roll to provide a self-supporting roll for mounting in a rotary dispenser.

In reloading dispensers, it is common practice to remove a partially consumed roll when placing a new roll into the dispenser. It is desirable to employ some method of using the partially consumed roll, sometimes called a "stub roll." If there is no convenient way to dispense the partially consumed rolls, then such rolls may not be used, undesirably increasing the overall cost of providing paper products to users.

OBJECTS AND SUMMARY OF THE INVENTION

Accordingly, it is an object of the present invention to provide an assembly for dispensing an absorbent roll, wherein the assembly is simple and economical to manufacture, install, and use. These and other objects of the invention are provided by the disclosed structure and method, or may be learned from practice of the invention.

In accordance with one aspect of the present invention, an assembly for dispensing an absorbent paper roll is provided having an interior space and an exterior cover. The assembly includes a pair of opposed support members, wherein the support members are adapted to engage sides of a paper roll. The support members are mounted on the interior of the housing in spaced relation to each other. In some embodiments of the invention, there is a first pair of projections within the interior space of the housing to articulate with sides of the roll, thereby forming a fixed mounting axis from which the roll may be dispensed. A stub roll unit side feature, sometimes called an "escort" or stub roll, facilitates the storage and dispensing of a partially dispensed roll in addition to the main or primary roll. Further, the assembly is adapted for automatically receiving and mounting a paper roll within the interior space of the housing upon the insertion of the paper roll into the housing.

The invention comprises a method and apparatus for more efficiently and easily dispensing paper products, such as toilet tissue, from commercial wall mounted dispensers. The dispenser may be re-loaded in most instances by way of a single operation that usually requires only one hand. Further, the housing protects the paper from vandals and improper tampering, while being configured for a simple reloading procedure without the necessity for using keys, locks, and the like to gain access to the housing.

The invention may comprise spring loaded projections on the interior of the housing that are adapted to receive and suspend within the housing rolls of paper tissue. Doors within the housing are configured to facilitate insertion of a new roll of paper into the dispenser when located in the open position. Further, such doors suspend the tail (end) of the paper roll for easy access to the tissue user when the doors are in the closed position.

In one embodiment, the projections are spring loaded. The opposed support members are biased against the sides of the paper roll in one configuration of the invention. The paper roll may contain a core, or alternatively, may be coreless. If the paper roll is coreless, the roll is supported within the housing by projections capable of articulating with indentations or spaces in the sides of the paper roll.

In accordance with another aspect of the invention, an assembly for dispensing a coreless absorbent paper roll is presented including a housing having an interior space and an exterior cover. Further, opposed support members are adapted to engage the sides a paper roll, the support members being mounted on the interior of the housing in spaced relation to each other within the housing. The assembly is adapted for automatically receiving and mounting a paper roll within the interior space of the housing upon insertion of the roll into the housing. A first pair of spring-loaded projections are provided within the interior space of the housing, adapted to engage indentations in the sides of the coreless paper roll forming a fixed mounting axis from which the coreless paper roll may be dispensed. A stub roll unit is adapted to dispense a partially consumed roll.

The assembly may further include a release mechanism to facilitate the release and removal of a paper roll from the assembly prior to depletion of the paper roll. In one embodiment, the assembly includes at least one door capable of holding the tail of a paper roll in spaced relation to the housing. The opposed support members typically are flexible, thereby facilitating engagement with opposite sides of the roll as the roll is inserted into the housing.

At least one of the first pair of projections may be actuable between: (a) a fully erect position for engaging a mounted paper roll, and (b) a disabled position to facilitate removal of a mounted paper roll from the assembly. Removal of a paper roll may be desirable, for example, when only one-half, or less, of the roll is remaining in the dispenser, and a period of heavy use is anticipated in the near future. The ability to remove a partially dispensed roll assists in preventing the undesirable depletion of the roll during a time when no maintenance personnel are available to refill the dispenser (i.e. sometimes called a "run out" condition).

In some embodiments, a release bar is used to actuate a projection, thereby enabling removal of a partially dispensed roll. The release bar may slidably engage the projection to disable the projection, thereby facilitating the removal of a paper roll from the assembly. The assembly further may include a second pair of projections capable of articulating with indentations in the sides of a coreless stub roll.

In some embodiments, the stub roll is oriented within the housing such that the ends of the stub roll are situated in parallel to the full paper roll. The assembly may further include a housing comprising one or more windows to facilitate visual observation of the amount of depletion of rolls in the housing.

In accordance with another aspect of the invention a method of mounting a new absorbent paper roll in a dispenser is provided. As a first step, existing stub rolls are removed from the primary dispensing means of the housing. Then, a new paper roll is placed adjacent to the dispenser and in alignment with the dispenser housing. The dispenser has elongated support members on its interior. Next, a new paper roll is inserted into the housing of the dispenser. The new paper roll engages elongated support members along the sides of the paper roll. As a next step, projections are activated on each side of the paper roll, to articulate with the paper roll and support the roll within the housing for dispensing paper to the exterior of the housing. Optionally, the stub roll may be mounted in a stub roll unit of the housing.

BRIEF DESCRIPTION OF THE DRAWINGS

A full and enabling disclosure of this invention, including the best mode shown to one of ordinary skill in the art, is set forth in this specification. The following Figures illustrate the invention.

DETAILED DESCRIPTION OF THE INVENTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made to this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention, which broader aspects are embodied in the exemplary constructions.

Figure 1:
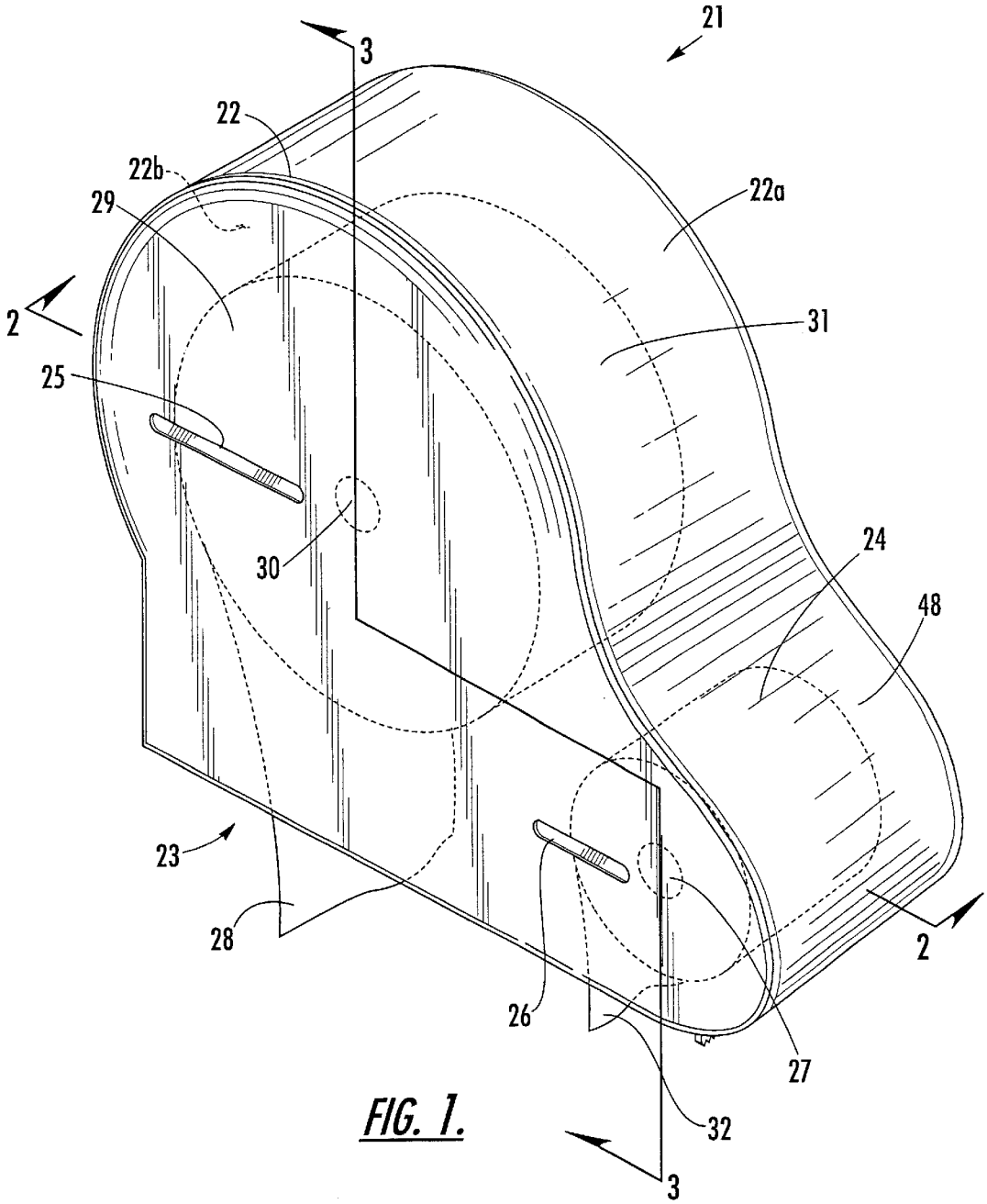
FIG. 1 is a perspective view of the dispenser with the accessory unit containing a stub roll.

Turning to FIG. 1, a dispenser is shown with a housing 21 having an exterior surface 22, a lower margin 23, and a side 31. Exterior cover 22*a* and interior surface 22*b* are also shown in the Figure. Tissue tail 28 is available to users below the housing. The housing typically is mounted on a restroom wall or stall. A paper roll 29 with center core space 30 having a relatively large size (8 inches in diameter is typical in the industry) is provided in the dispenser as shown on the left side of the Figure by dashed lines. A stub roll 24 having core space 27 is shown on the right portion of the housing within stub roll unit 48. A window 26 serves to indicate to maintenance personnel when the stub roll is nearly exhausted. A similar window 25 is provided detecting depletion of the roll 29.

Figure 2:
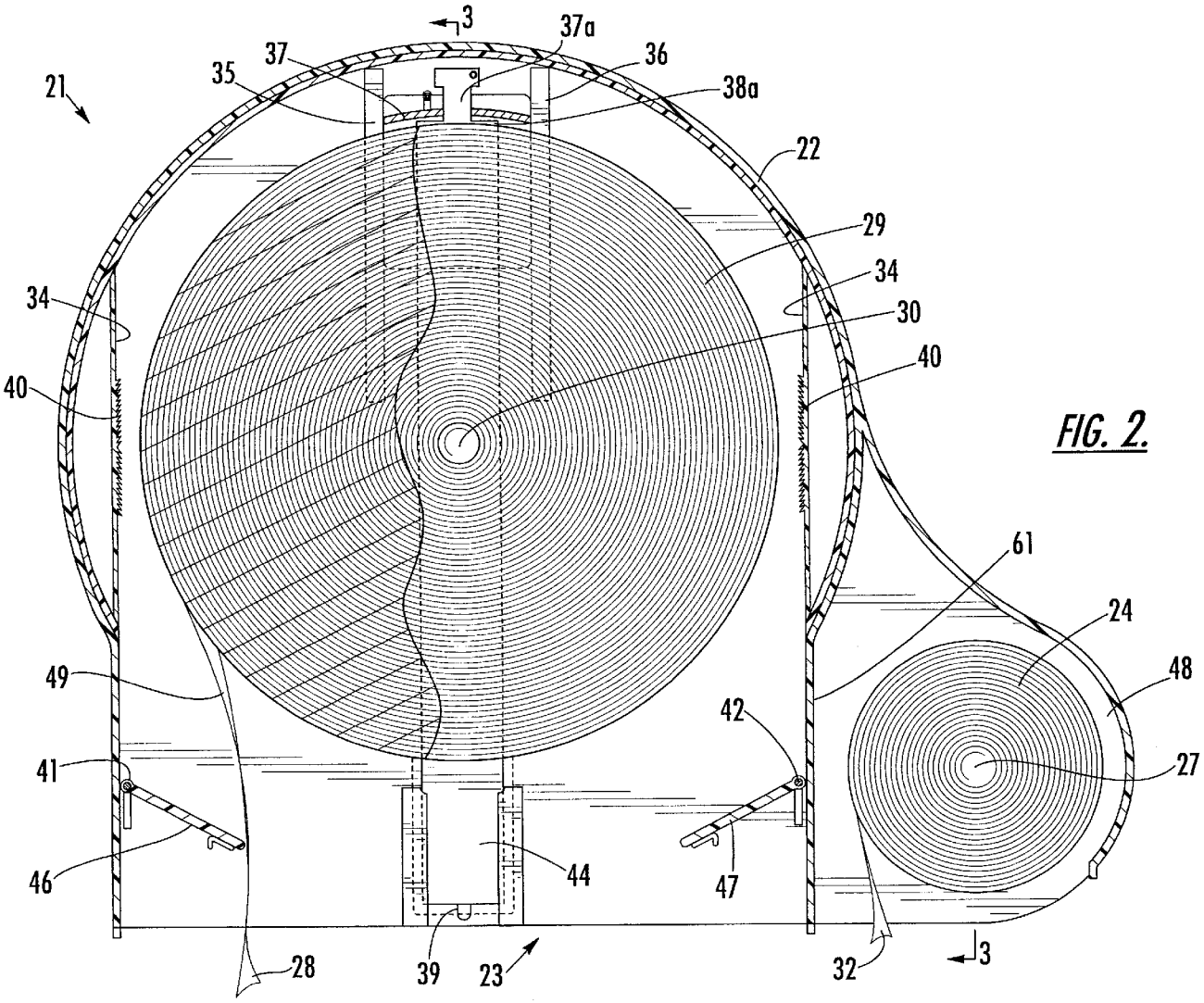
FIG. 2 shows a partial sectional side view of the dispenser taken along line 2—2 in FIG. 1.

FIG. 2 shows a cross-sectional view of the dispenser with bombay doors 46 and 47. Hinges 41 and 42 provide articulation for movement of the bombay doors from an open position to accommodate the insertion of a new paper roll to a closed position in which they act to suspend the paper tail 28 within reach by the user. Release bar 33 is an optional feature that facilitates the removal of a paper roll from the dispenser, as further discussed below in connection with FIGS. 7 and 8. Interior housing 34 and centering ribs 35 and 36 form a cavity for the paper roll 29. Plate 37 is mounted on end portions 37*a* and 37*b* at the upper portion of the housing so as to be vertically slidable between ribs 35 and 36. Plate 37 forms a curved surface against which the paper roll may be pushed to engage and lift t-bars 38 to thereby lift support members 43 and 44 to allow projections 50 and 55 to articulate with the core spaces 30 on either side of the paper roll, as will be further discussed below.

Figure 3:
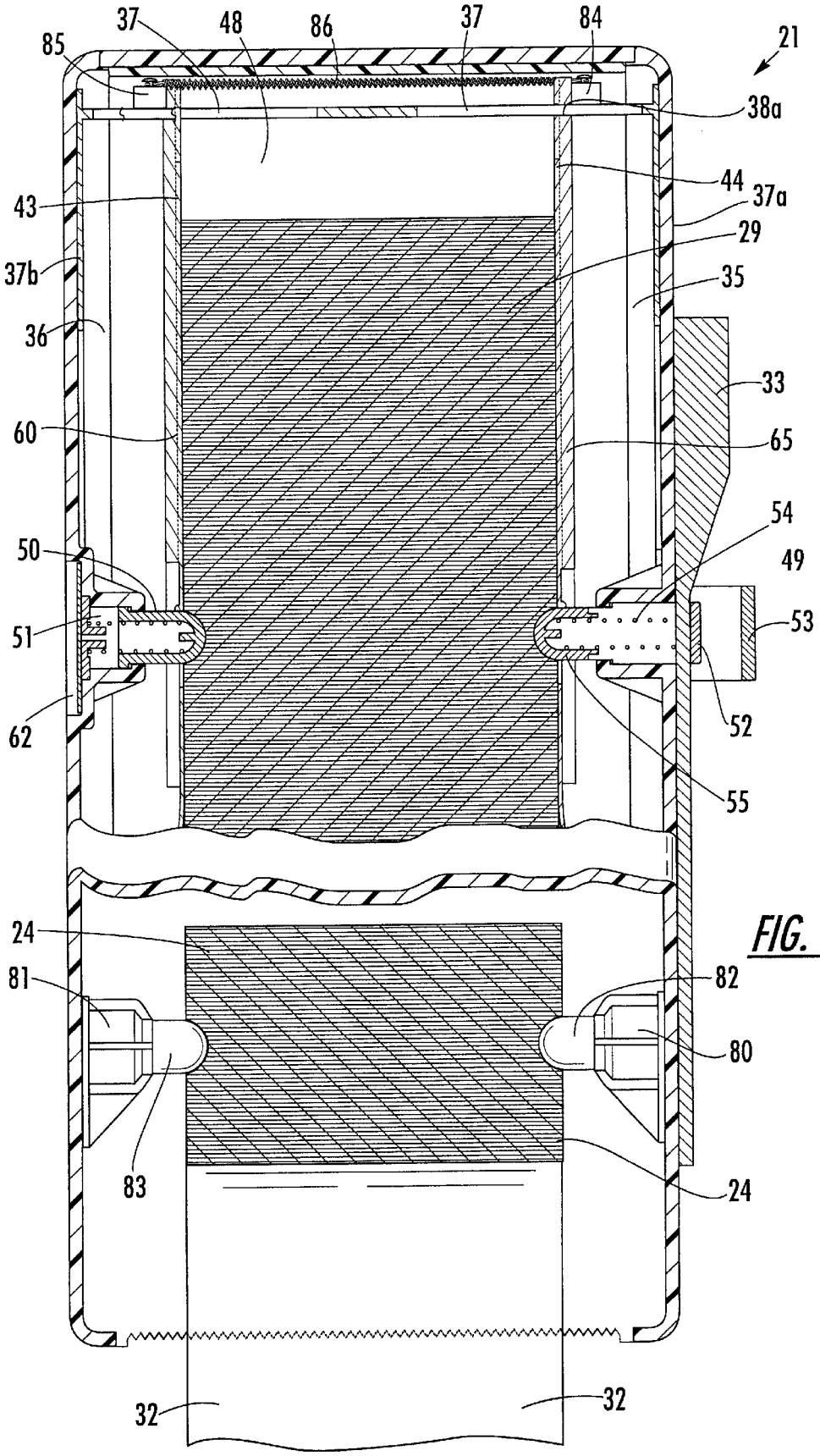
FIG. 3 shows an end partial sectional view (with cutaway) of the dispenser taken along line 3—3 in FIG. 1.

Spring cavities 39 are hollow spaces in which spring 45 and 88 may be placed for providing tensioning downward force on support members 43 and 44 (see FIG. 3). T-bars 38 extend from the tops of support members 43 and 44 to receive springs 86 and 87. Plate 37 typically rests on shoulders 37*a* adjacent t-bars 38, as shown in FIG. 2, when no paper roll 29 is presently in use. Tissue 49 is unwound from roll 29 and is held in spaced relation to the housing lower margin for convenient access by the user. Serrated gripping plate 40 on each interior wall of the housing serves to provide a frictional stop on the rotation of the roll when the roll is misaligned on its axis, such as if a cored roll is inserted into a coreless unit, preventing damage to the dispenser.

A stub roll unit 48 is shown on the right side of the housing, and it provides a stub roll 24 for feeding paper. Typically, when a new, full roll is inserted into the dispenser, the partially used stub roll 24 is first removed from the housing and placed in the stub roll unit 48. A dividing wall 61 separates the stub roll unit from the main housing.

As seen in FIG. 3, a first pair of support members 43 and 44 engage the sides of the roll, and flex during insertion of the roll. The support members are free to bend about their long axis when loaded with force. The support members are free to travel vertically, and are urged downward by springs 45 and 88 (seen in FIG. 5). Space 48 above the roll provides needed space to rotate the roll 29 on its axis, and to facilitate insertion into the dispenser. The support members are held by struts 60 and 65 respectively.

Interior housing 34 shown in FIG. 2 thus surrounds the paper roll, and provides centering ribs 35 and 36 which connect to the curved plate 37 while in the dispensing position.

Hub 49 in FIG. 3 helps seat and hold the primary paper roll. Lug 53 forms the end of the hub 49. Projection 55, which is bullet-shaped, is held in spring tension by spring 54 and is naturally tensioned to push into the paper roll. Spring-loaded retainer 51 is connected to base 62 on the opposite side of the housing as hub 49 and supports projection 50. Roll 29 is thus supported by projections 50 and 55.

Mandrel 52 is connected to the projection 55 such that under some circumstances the mandrel may be activated to compress the spring 54 to withdraw the bullet-shaped projection 55 into hub 49, facilitating removal of a roll. This removal operation is made possible by slidable movement of release bar 33, as further discussed below in connection with FIGS. 7 and 8.

FIG. 3 shows stub roll 24 in the lower portion of the Figure. C-adapters 80 and 81 include spring-loaded projections 83 and 82 on each end of the roll. These projections are injected into the holes or cavities at each end of a coreless roll to suspend the stub roll 24 in position for dispensing followed by spring-loaded projections 82 and 83 may be constructed and mounted similar to projection 50, so no further description of projections 82 and 83 is required hereon to describe and allow practice of the invention.

Figure 4:
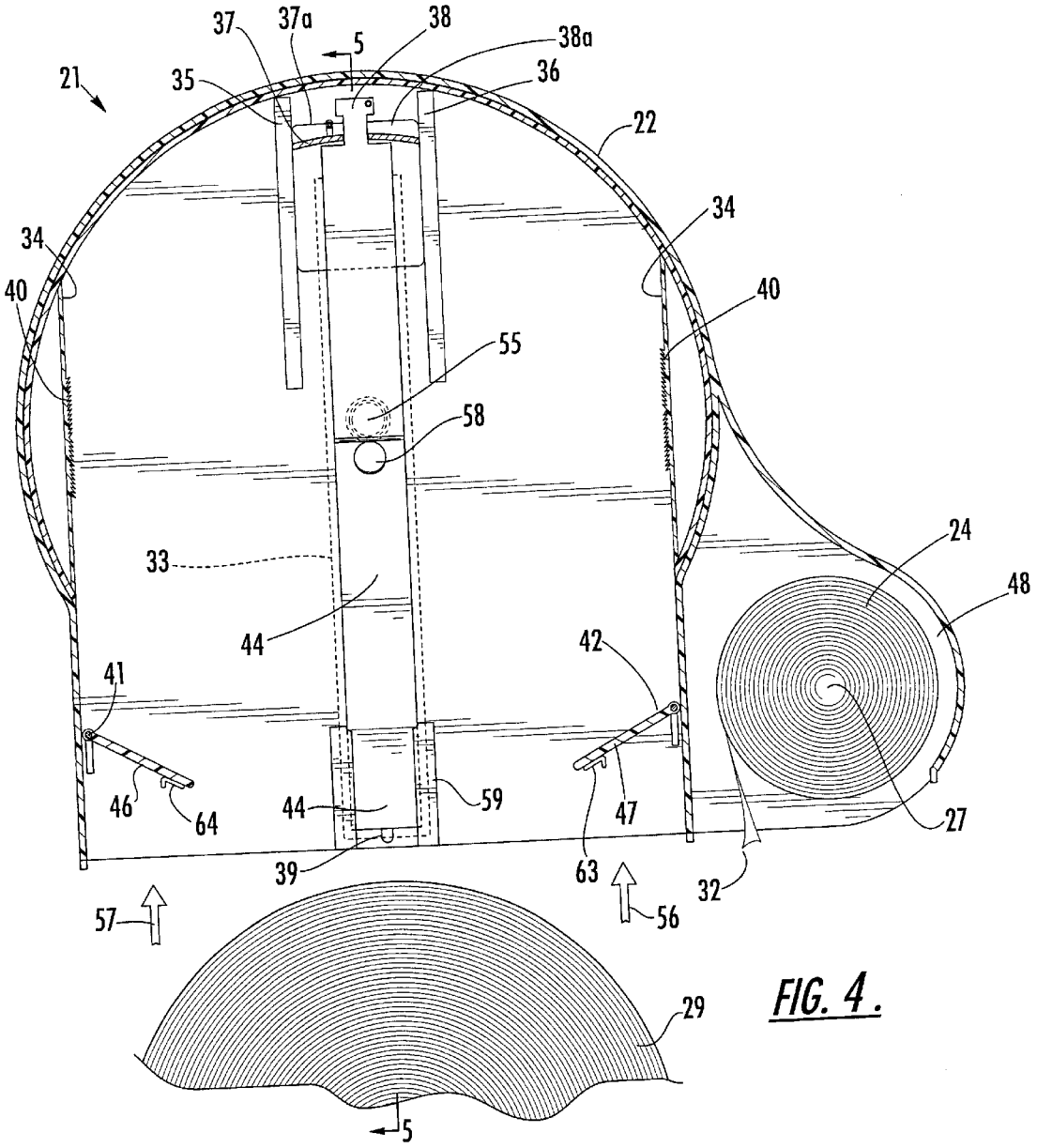
FIG. 4 illustrates loading a paper roll into the dispenser.

In FIG. 4, door supports 63 and 64 support the respective bombay doors. Retainer 59 provides a base for the flexible support members. Direction arrows 56 and 57 show the insertion pathway for paper roll 29. Engagement hole 58 provides a pathway for a projection 50 to proceed through the flexible support 44 and into the cavity of the paper roll.

Figure 5:
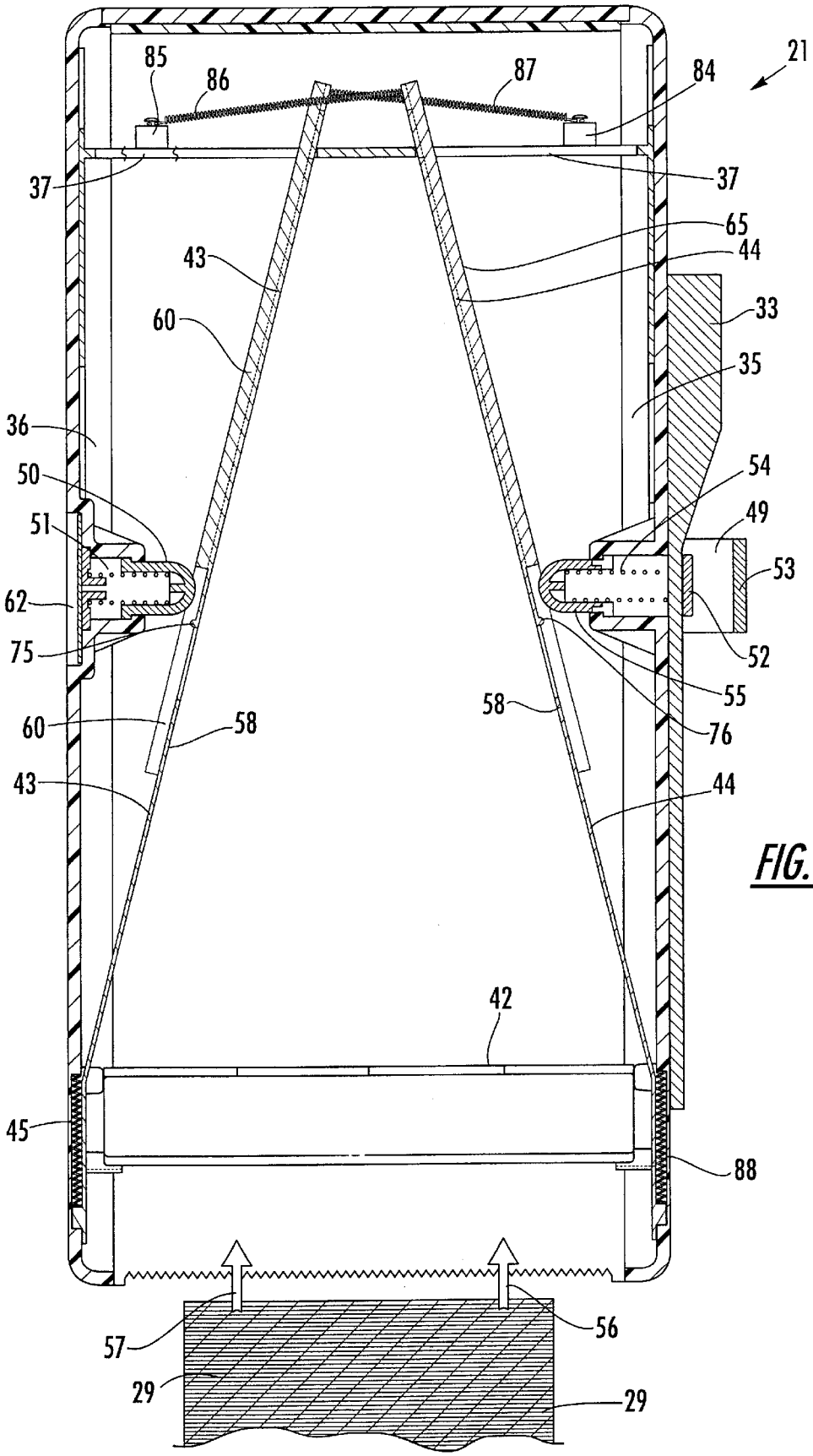
FIG. 5 shows a side view of the dispenser including the step of FIG. 4 illustrating the loading of a paper roll into the dispenser.

In FIG. 5, a side view shows the paper roll 29 being inserted into the housing. The flexible supports 43 and 44 are in an A-shaped configuration to receive the roll sides against their inner surfaces. During the insertion, projections 50 and 55 are pressed against the flexible supports 43 and 44 by spring action. As shown in FIG. 5, projections 50 and 55 do not yet protrude through the hole 58 in each flexible support 43 and 44. Spring 45 and spring 88 each provide a tensioning force for support members 43 and 44. Springs 86 and 87, which are connected to supports 84 and 85, also provide a tensioning force holding flexible support members 43 and 44 towards the midline of the dispenser. Struts 60 and 65 are intimately attached to support members 43 and 44.

Figure 6:
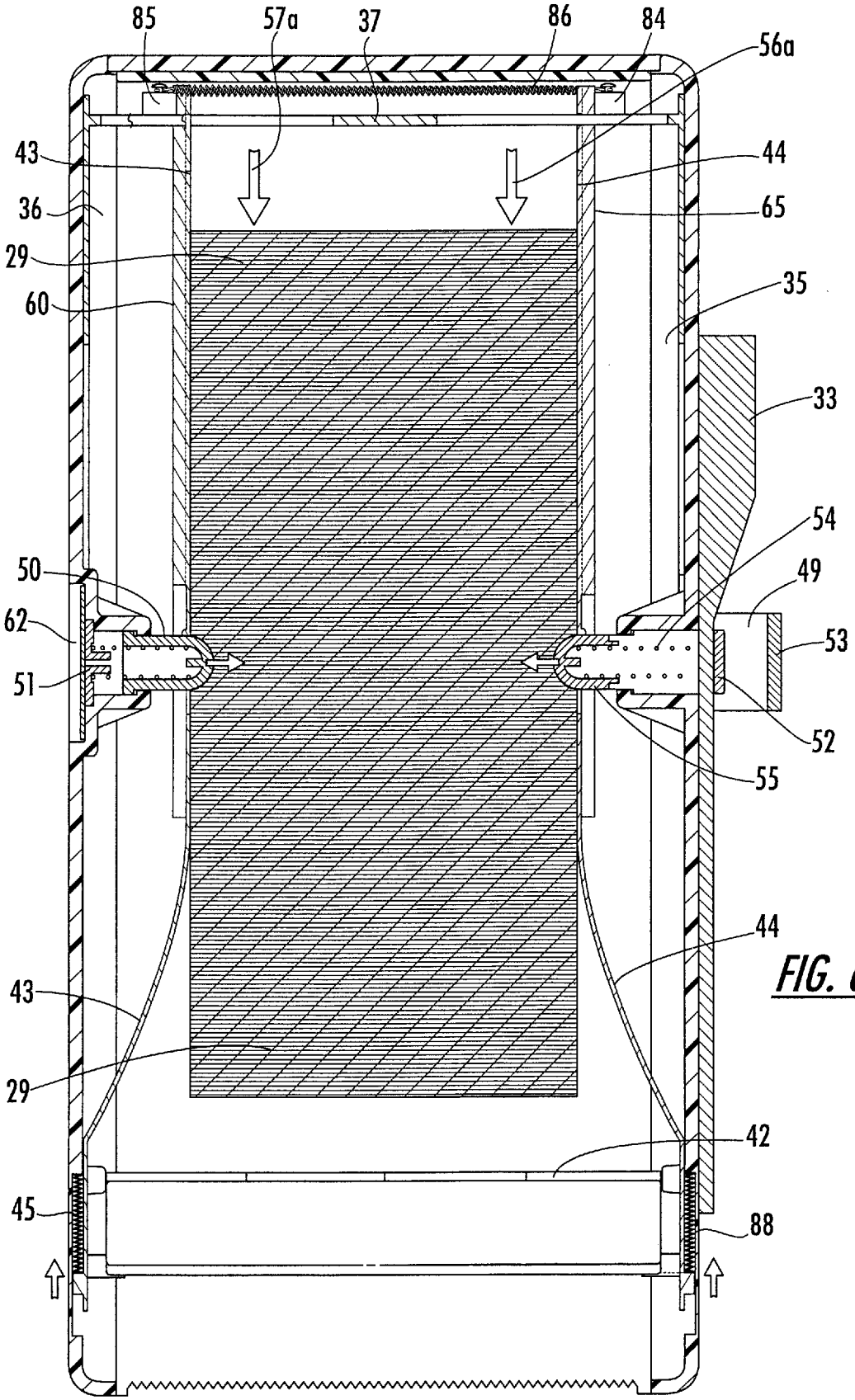
FIG. 6 is an end view showing the paper roll inserted fully into the dispenser.

FIG. 6 shows many of the features, which have been reviewed above, in a different orientation. For example, FIG. 6 shows the paper roll after insertion into the dispenser, in which the roll had been inserted upwards to the top of the interior housing against plate 37, and then dropped down in direction of arrows 56*a* and 57*a* into position such that projections 50 and 55 articulate with each side of the paper roll 29.

To insert a paper roll, the roll is pushed completely into the housing, with the plate 37 and t-bars 38 slid upward to the top of the housing. The upward force of the roll pushes the flexible supports upward and outward, compressing springs 45 and 88 and stretching springs 86 and 87. In FIG. 5, one can see notches 75 and 76 on the surface of the flexible supports. When the roll is inserted fully into the housing, the notches are pulled above the bullet-shaped projections 50 and 55 and urged outward. In FIG. 6, the projections 50 and 55 now have aligned with holes 58 in the flexible supports 43 and 44, and the projections protrude through the flexible supports to engage the indentations or cavities in each side of the paper roll, suspending the paper roll in the dispenser. The paper roll is now held firmly in place in the dispenser, and typically cannot be removed by simply pulling on the roll from below. The projections firmly engage the indentations in the coreless roll. In the case of a cored roll, the projections engage the free space inside the core.

Figure 7:
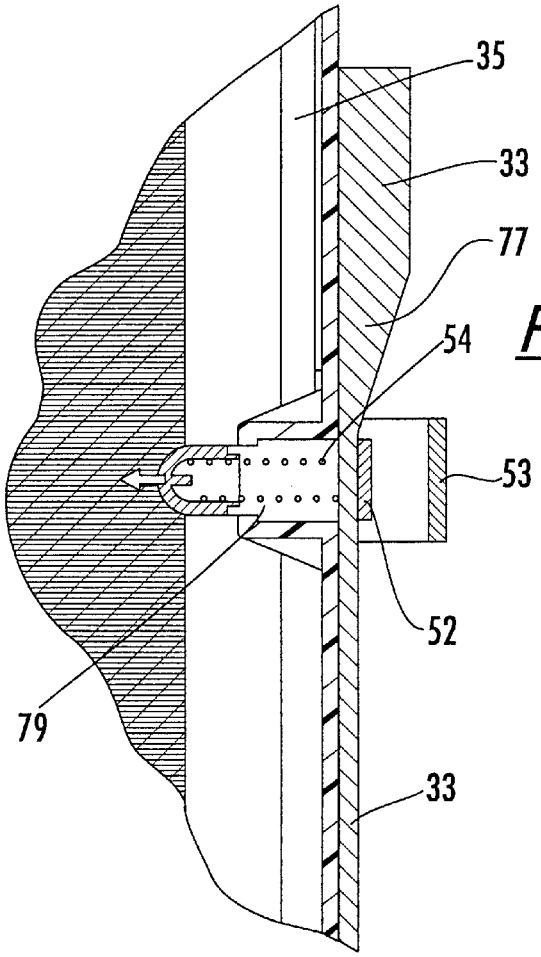
FIG. 7 is a cross-sectional view showing the spring-loaded projection inserted into the side of a paper roll.
Figure 8:
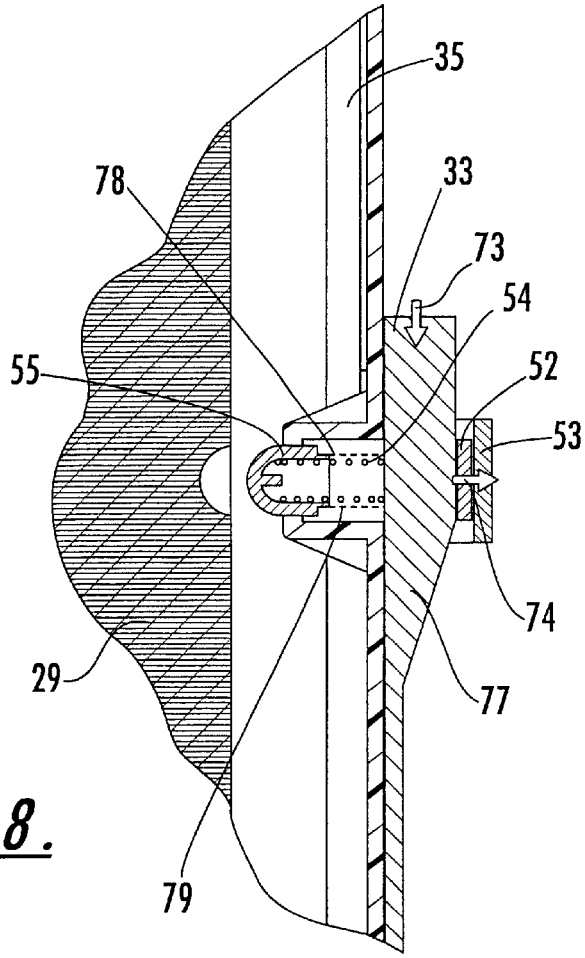
FIG. 8 shows the release bar pulled downward to disable the spring-loaded action of a projection, thereby facilitating removal of a full paper roll from the dispenser.

Release bar 33 is in the "up" position in FIG. 6 and 7, as the paper roll 29 is fully inserted into the housing. In FIG. 8, release bar 33 has been pulled into the "down" position in which it urges mandrel 52 to the right along with projection 55, thereby compressing spring 54. Projection 55 is thus no longer disposed within, into the paper roll 29. The projection 55 has two slots 78 and 79, which are directly in, line vertically with one another. When release bar 33 is pulled into the down position, track section 77 (see FIGS. 7 and 8) of the release bar is placed through the slots. In this configuration, the projection is relaxed and no longer is applying a horizontal force into the paper roll 29. Thus, the paper roll 29 may be removed from the dispenser when release bar is pulled down into the release position, as shown in FIG. 8.

Removal of a partially used paper roll from the dispenser is especially useful in those situations in which a period of very heavy use of the dispenser is anticipated, or where there is likely to be no opportunity to refill the dispenser during the period of heavy use. Other times in which removal of a roll is advantageous is in the situation in which paper roll 29 becomes contaminated or damaged. One example of such damage is a soaking with water, such as may occur in a restroom washdown. In that instance, the ability to release a paper roll 29 and remove it from the dispenser is valuable. Once a partially used roll (stub roll) is removed, it may be placed into the dispenser stub roll unit so that both the stub roll and the primary roll 29 are then available for use for a period of time.

Figure 9:
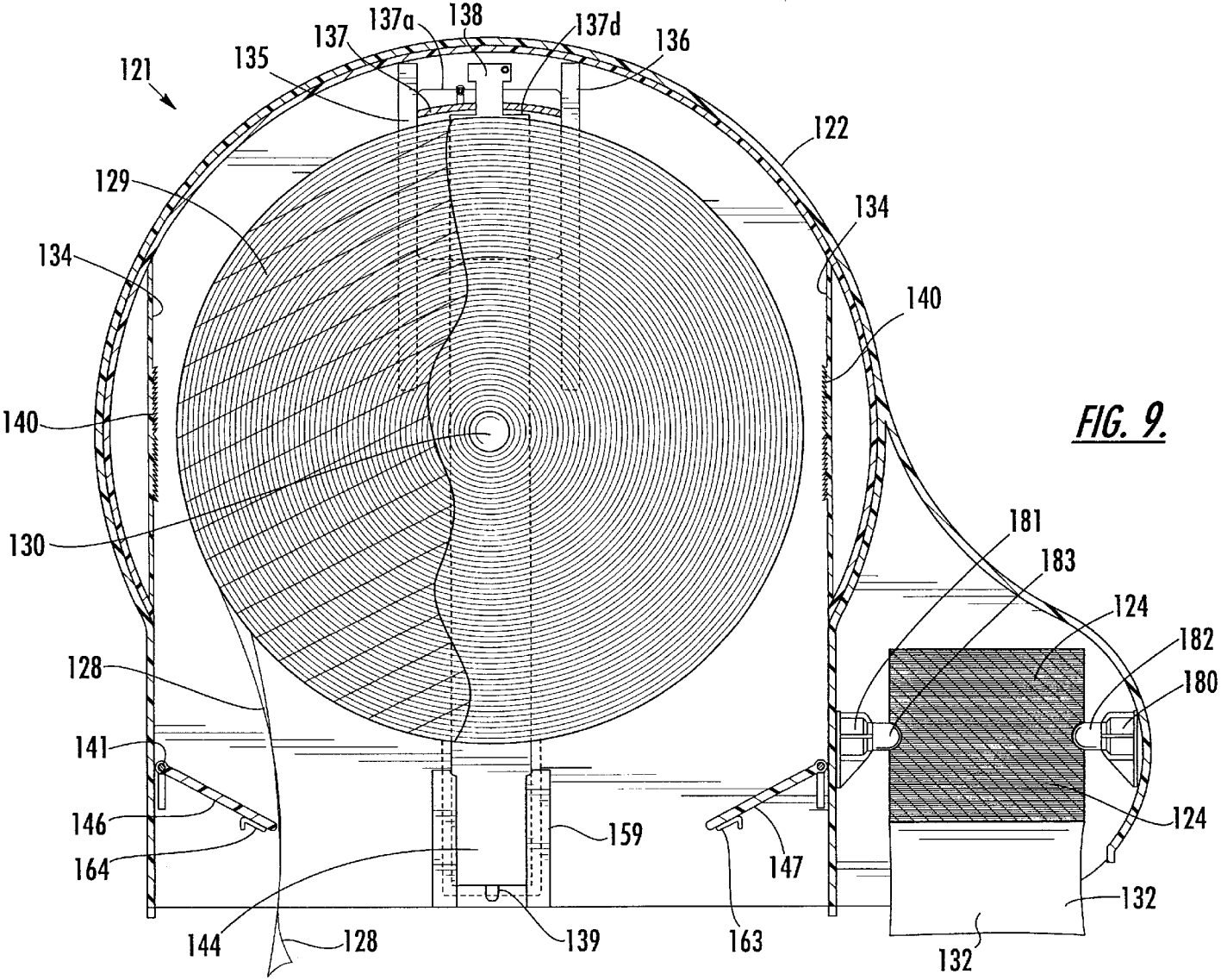
FIG. 9 shows another embodiment of the invention with the stub roll facing in a direction that is offset ninety degrees from the embodiment shown in FIG. 1, such that paper feeds from the stub roll in a plane that is perpendicular to the plane of paper feed from the primary roll.

FIG. 9 shows another embodiment of the invention 121 with the stub roll 124 facing in a direction that is offset ninety degrees from the embodiment shown in FIG. 1, such that paper feeds from the stub roll in a plane that is perpendicular to the plane of paper feed from the primary paper roll 129. Otherwise, the structure and operation of embodiment 121 is substantially similar to that of embodiment 21. Like reference numerals are used to identify like parts in the disclosed embodiments.

The invention is particularly set forth in the appended claims. Further, it should be understood that aspects of the various embodiments disclosed in this specification may be interchanged both in whole or in part without departing from the invention. Furthermore, those of ordinary skill in the art will appreciate that this description is by way of example only, and is not intended to limit the invention as described in the claims.

What is claimed is:

1. An assembly for automatically mounting and then dispensing an absorbent paper roll, comprising:

a housing having an interior space and an exterior cover, and at least one paper roll insertion pathway extending into the interior space of the housing, a pair of opposed elongated support members, wherein the elongated support members are adapted to movably engage the sides of a paper roll, the elongated support members being mounted on the interior of the housing in spaced relation to each other, a first pair of projections within the interior space of the housing, at least one projection being operably connected to an elongated support member, said projections being adapted to engage the sides of the paper roll upon displacement of the elongated support members by insertion of the paper roll into the interior space of the housing along the insertion pathway, the projections being adapted to form a fixed mounting axis from which the roll may be dispensed, and a stub roll unit, wherein the stub roll unit is adapted to dispense a partially consumed roll, the stub roll unit comprising a suspension apparatus for operatively engaging and dispensing a stub roll, wherein the assembly is adapted for automatically receiving and mounting a paper roll through the insertion pathway within the interior space of the housing upon the insertion of the paper roll into the housing.

2. The assembly of claim 1 wherein the first pair of projections is spring loaded.

3. The assembly of claim 1 wherein the opposed support members are tensioned against the sides of the paper roll.

4. The assembly of claim 1 wherein the apparatus comprises a second pair of projections to support a stub roll.

5. The assembly of claim 4 wherein the second pair of projections are capable of articulating with indentations in the sides of a coreless paper roll.

6. An assembly for dispensing a coreless absorbent paper roll and a stub roll, comprising:

a housing having an interior space and an exterior cover, opposed support members, wherein the support members are adapted to engage the sides a paper roll, the support members being mounted on the interior of the housing in spaced and tensioning relation to each other within the housing, a first pair of spring-loaded projections within the interior space of the housing, said projections being adapted to engage indentations in the sides of the coreless paper roll thereby forming a fixed mounting axis from which the coreless paper roll may be dispensed, and a stub roll unit, wherein the stub roll unit is adapted to dispense a partially consumed roll, the stub roll holder comprising a suspension apparatus for operatively engaging a stub roll in dispensing paper, wherein the assembly is adapted for automatically receiving and mounting a paper roll within the interior space of the housing upon the insertion of the roll into the housing.

7. The assembly of claim 6 additionally comprising a release mechanism to facilitate the release and removal of a paper roll from the assembly.

8. The assembly of claim 6 wherein the assembly includes at least one door capable of holding the tail of a paper roll in spaced relation to the housing.

9. The assembly of claim 6 wherein the stub roll is oriented within the housing such that the ends of the stub roll are oriented in the same direction as the ends of the coreless absorbent paper roll.

10. The assembly of claim 6 wherein at least one of said first pair of projections is actuable between: (a) a fully erect position for engaging a mounted paper roll, and (b) a disabled position to facilitate removal of a mounted paper roll from the assembly.

11. The assembly of claim 10 additionally comprising a release bar to actuate a projection.

12. The assembly of claim 10 wherein the release bar slidably engages the projection to disable the projection, thereby facilitating the removal of a paper roll from the assembly.

13. The assembly of claim 10 wherein the housing comprises one or more windows to facilitate the visual observation of the level of depletion of rolls within the housing.

14. The method of mounting a new absorbent paper roll in a dispenser housing, comprising the steps of:

(a) placing a new paper roll adjacent to the dispenser and in alignment with the dispenser housing, the dispenser housing having elongated support members on its interior, (b) inserting the new paper roll into the housing, (c) engaging elongated support members with the sides of the new paper roll, the elongated support members being displaced by insertion of the paper roll into the housing, (d) activating projections on each side of the paper roll, (e) supporting the paper roll by articulation of the projections with sides of the paper roll, (f) wherein the paper roll is mounted within the housing and is capable of dispensing paper to the exterior of the housing.

15. The method of claim 14 in which the paper roll is coreless.

16. The method of claim 14 comprising the additional step of mounting the stub roll removed in step (a) into a stub roll unit of the housing.

17. The method of claim 16, comprising the additional step of pushing the paper roll against a surface within the housing, thereby activating the projections in articulation with sides of the paper roll.

18. The method of claim 16 comprising the additional step of removing a paper roll from the housing by activating a release mechanism.

19. The method of claim 18 in which the release mechanism is a release bar.

20. The method of claim 19 in which the release bar is activated from the exterior of the housing and operates to disengage the spring of a projection, thereby facilitating removal of a paper roll from the housing.

* * * * *